United States Patent [19]

Kuznetsov et al.

[11] Patent Number: 4,473,976

[45] Date of Patent: Oct. 2, 1984

[54] PRESTRESSED COOLING TOWER

[75] Inventors: Edward N. Kuznetsov; Jack J. Groom, both of Columbus, Ohio

[73] Assignee: Battelle Development Corporation, Columbus, Ohio

[21] Appl. No.: 32,409

[22] Filed: Apr. 23, 1979

[51] Int. Cl.[3] ..... E04G 11/04

[52] U.S. Cl. ..... 52/80; 52/83; 52/245; 261/DIG. 11

[58] Field of Search ..... 261/DIG. 11, 108; 52/83, 80, 245

[56] References Cited

U.S. PATENT DOCUMENTS

| | | | |
|---|---|---|---|
| 3,922,822 | 12/1975 | Mollinger | 52/83 |
| 3,945,106 | 3/1976 | Mayr | 52/741 |
| 4,010,580 | 3/1977 | Mayr | 52/80 |
| 4,148,850 | 4/1979 | Schulte | 52/83 |
| 4,173,102 | 11/1979 | Judge | 52/73 |

FOREIGN PATENT DOCUMENTS

| | | | |
|---|---|---|---|
| 2154530 | 2/1973 | Fed. Rep. of Germany . | |
| 2243222 | 3/1974 | Fed. Rep. of Germany . | |
| 2243484 | 3/1974 | Fed. Rep. of Germany | 52/83 |
| 2243485 | 3/1974 | Fed. Rep. of Germany | 52/83 |
| 2311183 | 9/1974 | Fed. Rep. of Germany . | |

*Primary Examiner*—Henry E. Raduazo

*Attorney, Agent, or Firm*—Barry S. Bissell

[57] ABSTRACT

Disclosed is a structure of flexible tensile members which requires only two arrays of said members for obtaining lateral stiffness of said structure, the ends of each member being attached to contour elements and the members of each array having opposite curvatures for forming an axisymmetric geodesic network which is a section of a surface of revolution. The members of both arrays are prestressed and said network is geometrically arranged to be torque-balanced within said contour elements.

16 Claims, 7 Drawing Figures

PRESTRESSED COOLING TOWER

DESCRIPTION

Background of the Invention

The present invention relates to structures composed of tensile members and more particularly to such a structure having lateral stiffness and being torque-balanced using only two arrays of flexible tensile members Such structures may form a continuous envelope, thus making them suitable for a variety of applications, such as for cooling towers, suspended roofs, and other shell-type structures. Presently, such structures constructed from three sets of tensioned structural members or a continuous membrane are known for natural draft cooling towers. One such structure is known as the Schmehausen cable net tower described in German Pat. Nos. 2,243,222 and 2,255,793 (corresponding to U.S. Pat. No. 3,945,106). Such a tower is constructed from three intersecting sets of cables which form a structural cage which is subsequently clad from the inside with corrugated aluminum sheeting. One set of cables is in the meridional direction and the other two cable sets are set at equal but opposite angles from the meridian, and the intersection of such sets of cables is secured. Another variation of such a three-set tensioned structural member natural draft cooling tower is shown in German Pat. No. 2,154,530, while in U.S. Pat. No. 4,010,580 the envelope of the tensioned cooling tower is constructed from a continuous membrane.

All such structures can be difficult to erect (especially for cooling towers several hundred feet in height) and can be costly because of the number of fixed intersections of members required or the difficulty in uniformly tensioning a continuous membrane. Also, maintenance of such structures can be expensive.

Advantages of the present invention include the necessity for using only two sets of structural members for forming the structure, which sets or arrays of structural members are not connected at their intersection. Also, such a structure possesses lateral stiffness, is torque-balanced, and has uniform tension throughout each member; thus, providing optimum strength of the structure. Further, erection and maintenance of a cooling tower employing such novel structure is comparatively easier to accomplish and less expensive than prior three-set or membrane structures. These and other advantages will become readily apparent to those skilled in the art from the disclosure of the invention detailed herein.

BROAD STATEMENT OF THE INVENTION

The present invention is a structure of flexible tensile members which requires only two arrays of said members for obtaining lateral stiffness or ostensible rigidity of said structure. The ends of each member are attached to contour elements and the members of each array have opposite curvatures for forming an axisymmetric geodesic network which is at least a section of a surface of revolution. The first array forms an angle $\alpha$ with respect to the meridian of said surface of revolution, where $\alpha$ is greater than $-90°$ but less than $0°$ from said meridian. The second array forms an angle $\beta$ with respect to the meridian of said surface of revolution, where $\beta$ is greater than $0°$ but less than $90°$ from said meridian. The absolute value of the angle $\beta$ is greater than the absolute value of the angle $\alpha$ in the structure.

The members of both arrays are prestressed and said network is torquebalanced within said contour elements. The members of the two arrays are not secured or fastened at any of their points of intersection.

A process for erecting such structure wherein said network forms a surface of revolution having a negative Gaussian curvature (a hyperbolic surface of revolution) comprises attaching ends of said members of said first array to a rigid upper ring member and positioning said array-attached ring member about the upper end of a central support (compression) column. A first portion of the ends of said members of said first array (for example, every other member) is attached to a lower rigid ring member having points of attachment for said first array and said second array, and concommitantly therewith the other portion of the ends of said members of said first array are temporarily attached to the points of attachment of said second array on said lower ring member. Both portions of said members of the first array are prestressed to induce a sparse, slightly prestressed network of said members. The portion of said members temporarily attached to said second array attachment points then are replaced one-by-one with the second array while the other ends of said second array are attached to said upper ring and the second array tensioned, and the replaced other portion of said members of said first array are attached and tensioned to their final point of attachment on the lower ring member. Optionally, a final tension adjustment can be made for all individual members of both arrays.

DETAILED DESCRIPTION OF THE DRAWINGS

Figure 1:
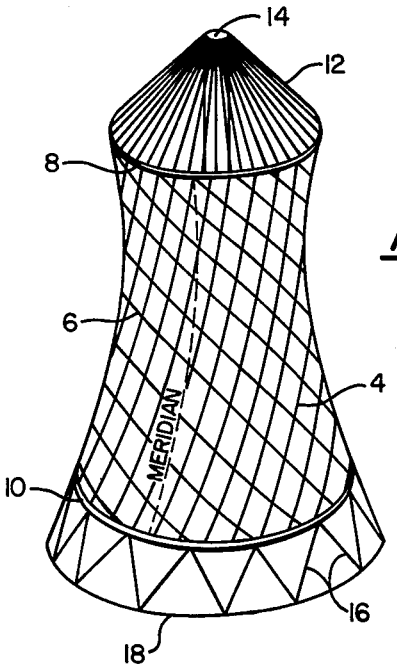
FIG. 1 is a natural draft cooling tower constructed from the novel structure.

The suspended natural draft cooling tower of FIG. 1 has a thin-wall envelope formed by the two arrays of tensile members 4 and 6. The upper ends of the members are connected to upper ring member 8 and the lower ends of the members are connected to transition joint 10. Upper ring element 8 is suspended by cables 12 from compression column 14 in conventional fashion. Anchoring cables 16 firmly secure transition joint 10 by attachment to tension foundation anchors 18. The precise geometrical arrangment of members 4 and 6 will be described later.

Figure 2:
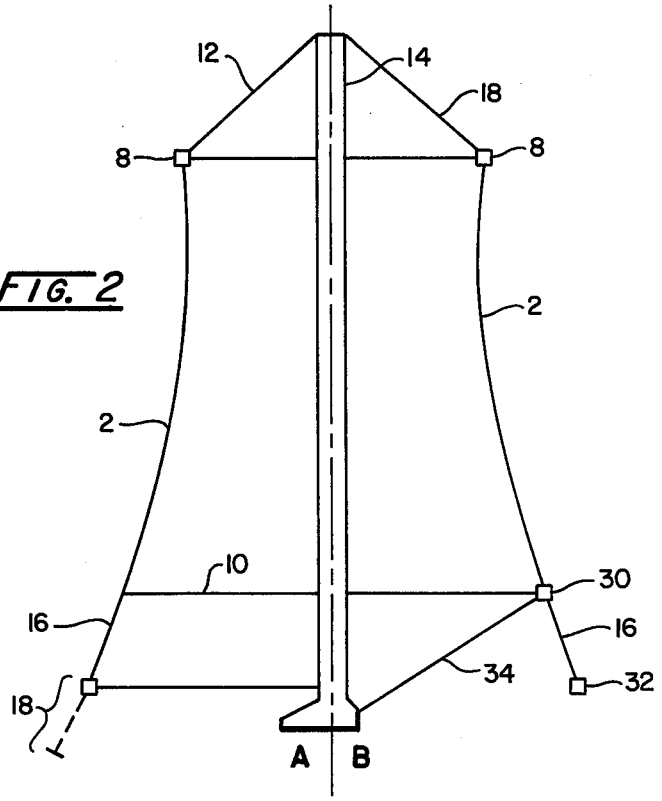
FIG. 2A is a cross section elevation view of the tower of FIG. 1.
FIG. 2B is an alternative design for such tower.

FIG. 2A shows the tower of FIG. 1 in cross-sectional elevation along a meridian of surface (or envelope) 2. FIG. 2B shows an alternative to the design of the tower in FIG. 2A wherein members 4 and 6 are connected to lower ring member 30 which is secured to the ground by anchoring cables 16 and foundation support 32, and by means of lower suspension cables 34. Such an arrangement excludes the ground as a link in the self-balanced system of prestressing forces of the structure and results in a much smaller foundation for the tower. Where ground space is limited or unsuitable for large foundations, the design depicted in FIG. 2B may be desirable. It should be appreciated that either or both of the two ring members may be adjustably attached to the compression column to (uniformly) adjust the tension in the arrays by movement of the rings up-and-down the column.

DETAILED DESCRIPTION OF THE INVENTION

The novel structure of the present invention is unique in its lateral stiffness in a torque-balanced network which requires only two arrays of flexible tensile members. The lateral stiffness or rigidity results from the opposed curvatures of the two arrays of members. The tensile members of each array have opposed curvatures. Such opposed curvatures permits prestressing and results from the unique geometric arrangement of each array. The arrays form an axisymmetric geodesic network which is an areal section of a surface of revolution. A network composing a surface of revolution (bounded by the contour elements) is suitable for forming a cooling tower as described above. A network composed of an areal section of such surface is suitable for forming a suspended roof as well as other shell-type structures as the skilled artisan will appreciate. Regardless of the size of the section of the surface of revolution which the network forms, each array can be mathematically described relative to the surface of revolution of the network, and such description will be used in this application.

As mentioned above, because of the unique geometrical arrangement of the network of members, prestressing of the members causes the two arrays of members to exert mutual lateral pressure against each other. Such mutual pressure is the source of the lateral stiffness or ostensible rigidity of the network. In order for the structure to be torquebalanced, the circumferential components of the initial forces of prestressing in the two arrays should cancel each other. Such cancellation means that the resultant force of the arrays acts in the meridional direction and the network as a whole, taken as a free body, is torque-balanced.

It should be emphasized that only two arrays of tensile members are required for achieving the novel structure. While additional arrays of tensile members can be added to the structure, they are not required for achieving the lateral stiffness and torque-balancing of the structure.

The first array of tensile members forms an angle $\alpha$ with respect to the meridian of said surface of revolution, where $\alpha$ is greater than $-90°$ but less than $0°$ from said meridian, and preferably between about $-60°$ and $-5°$. The second array forms an angle $\beta$ with respect to the meridian of said surface of revolution, where $\beta$ is greater than $0°$ but less than $90°$ from said meridian, and preferably between about $7°$ and $80°$. The absolute value of angle $\beta$ always is greater than the absolute value of angle $\alpha$ (i.e. $|\beta| > |\alpha|$). That angles $\alpha$ and $\beta$ do not have the same value is necessary in order to have opposite curvatures for the two arrays. Thus, the two arrays are not symmetric with respect to the meridian.

For a further understanding of the novel structure of the present invention, the following brief mathematical discussion of the network is given. The mathematical relationships and equations developed below have been developed from the general theories relating to flexible member structures which can be found in the following references:

"Theory of Instantaneously Rigid Nets," E. N. Kuznetsov, Translation of the Soviet Journal of Applied Mathematics and Mechanics, PMM Volume 29, No. 3, Pergamon Press Ltd. (1965);

"Introduction to the Theory of Cable Systems, " E. N. Kuznetsov, Stroiijdat, Moscow, (1968); and "Design of Shells out of Bands," E. N. Kuznetsov, IASS Pacific Symposium — Part II on Tension Structures, Tokyo, (1971), the disclosures of which are expressly incorporated herein by reference. According to the theories propounded in the foregoing articles, a flexible member network as a mechanical system is characterized by its static vector, $S_i$, which is a function of geodesic and normal curvatures and some other parameters of the network. The cornerstone theorem for such a system may be stated as follows:

In order for a cable network consisting of two arrays of tensile members to allow prestressing, it is necessary and sufficient that its static vector be gradient:

$$S_i = \frac{\partial S}{\partial x_i}\ ;\ i = 1,2 \tag{1}$$

This equation means that the two components of the static vector are partial derivatives of some scalar function, S, called the static potential, where $x_1$ and $x_2$ are any two coordinates on the surface of the network. The initial forces induced by prestressing in the two arrays of members can be expressed by the following equations:

$$T_\alpha{}^* = C\sigma_\beta \exp S,\ T_\beta{}^* = -C\sigma_\alpha \exp S \tag{2}$$

In equation 2, C is an arbitrary constant, $\sigma_\alpha$ and $\sigma_\alpha$ are the normal curvatures of the two respective arrays of members, and the forces $T_\alpha{}^*$ and $T_{62}{}^*$ refer to unit width strips $ds_\beta = 1$ and $ds_\alpha = 1$, respectively, i.e. to unit increments of the complementary linear elements. Note, that for the forces in the two arrays of members to be positive for the required tension therein, the normal curvatures must be of opposite sign, which means that the surface of the network is of negative Gaussian curvature.

The structure of the present invention is defined as at least an areal section of a surface of revolution. A surface of revolution can be defined by its lines of principal curvature, meridians and parallel circles. The angles $\alpha$ and $\beta$, formed by the two respective arrays of members with the meridian (see FIGS. 3 and 4) depend only on the axial coordinate, z, directed along the axis of revolution. Since $\alpha$ and $\beta$ are the same for all members of their respective array, the network possesses axial symmetry. For such an axisymmetric geodesic network, the static vector in the system can be expressed by the following equation:

$$S_i = -\frac{1}{\sin\omega}\left(\frac{\sigma_\alpha'}{\sigma_\alpha} v^1 u_i - \frac{\sigma_\beta'}{\sigma_\beta} u^1 v_i\right) + \frac{1}{\sin^2\omega}\left[\lambda_\alpha(u_i - v_i\cos\omega) - \lambda_\beta(v_i - u_i\cos\omega)\right] \tag{3}$$

where $\omega = \beta - \alpha$ is the net angle, the prime denotes a derivative with respect to z; $\lambda_\alpha$ and $\lambda_{62}$ are the Tchebyshev curvatures of the net as expressed by:

$$\lambda_\alpha = \frac{\beta'}{A}\cos\alpha + \frac{B'}{AB}\sin\alpha,\ \lambda_\beta = \frac{\alpha'}{A}\cos\beta + \frac{B'}{AB}\sin\beta, \quad (4)$$

and $u_i$, $u^i$, $v_i$ and $v^i$ are the directional unit vectors of the member lines of the array.

The Lame' parameters, A and B, for the coordinate lines $(z,\phi)$ of the principal curvature of the surface can be expressed as:

$$A = \sqrt{1 + r'}\ ,\ B = r, \quad (5)$$

where $r=r(z)$ is the radius of revolution and $\phi$ is the polar angle.

The static potential, S, is a function solely of z. Because of axial symmetry, both components $S_1$ and $S_2$ also are functions of z only. Therefore, the derivative of the static potential, $\partial S/\partial\phi$, must equal zero. Satisfying this latter condition uniquely separates the networks of the present invention from all other axisymmetric geodesic networks. By virtue of the Clairaut theorem, $$r\sin\alpha = b,\ r\sin\beta = c \quad (6)$$

where constants b and c define the two respective arrays of geodesic lines on a surface of revolution. Thus, the following closed form equation characterizing the networks of the present invention can be derived:

$$\frac{\sigma_\alpha}{\sigma_\beta} = C_1\frac{\cos\alpha}{\cos\beta} \quad (7)$$

where $C_1$ is an arbitrary constant.

Of all axisymmetric geodesic networks, only those satisfying Equation (7) will permit prestressing of the members. When prestressed, the two arrays of members in the network will exert mutual lateral pressure against each other because of their opposed curvatures. Such mutual pressure is the source of the lateral stiffness or effective rigidity of the network of the novel structure of the present invention. Since there is a constant in Equation (7), the network can additionally be designed so that the circumferential components of the two initial forces of the arrays cancel each other (see FIG. 4). In this situation the resultant force acts in the meridional direction only and the network as a whole, taken as a free body, would be torque-balanced, in which case the following equation holds true:

$$T_\alpha^* ds_\beta \sin\alpha + T_\beta^* ds_\alpha \sin\beta = 0 \quad (8)$$

Since the angle $\beta > 0$ and both of the forces in Equation (8) are assumed to be positive, it follows that the angle $\alpha$ must be negative for such a torque-balanced network. It also follows that for such a network, the arbitrary constant in Equation (7) becomes uniquely specified as:

$$C_1 = \frac{\sin\alpha}{\sin\beta} = \frac{b}{c}. \quad (9)$$

Substituting Euler's Formula in the foregoing relationships, the static potential of the network can be expressed as follows:

$$S = \ln\frac{\sin\omega}{\sigma_2\sin(\beta+\alpha)} + \ln C \quad (10)$$

where C is an arbitrary constant reflecting the intensity of prestressing, and the initial forces in the two arrays of members can be expressed as:

$$T_\alpha^* = C\frac{\sin\omega\cdot\sin\beta}{\cos\alpha},\ T_\beta^* = -C\frac{\sin\omega\cdot\sin\alpha}{\cos\beta} \quad (11)$$

The forces expressed in Equation (11) relate to unit increments of linear elements, $ds_\beta$ and $ds_\alpha$, respectively.

Figure 3:
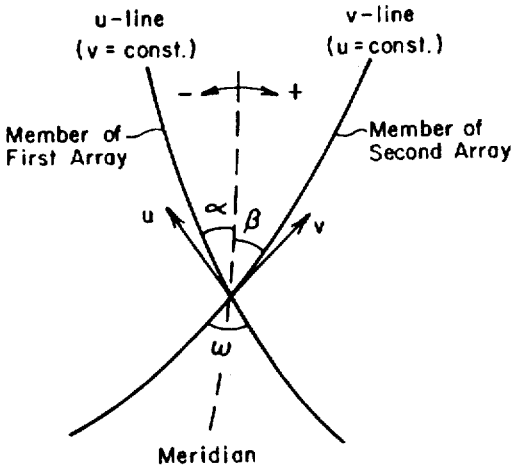
FIGS. 3–6 show mathemetical and geometric arrangements of the members of the structure and of the structure itself and will be described in detail in connection with a description of the mathematical theory behind the novel structure given below.
Figure 4:
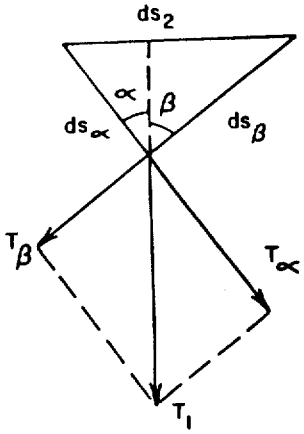

More physically meaningful for the design and construction of the novel structure of the present invention are the forces, $T_\alpha$ and $T_{62}$, per unit increments $dv=1$ and $du=1$ of coordinates of the member lines (see FIG. 3 and FIG. 4). Each of these unit increment strips contains a certain constant number of members. To convert to forces $T_\alpha$ and $T_\beta$, the initial prestressing forces must be multiplied by the Lame' parameter $B_n$ and $A_n$ of the first quadratic form of the network. Using the equations of the u-lines and the v-lines on the surface of the network (see FIG. 3), forces $T_\alpha$ and $T_\beta$ can be expressed as follows:

$$T_\alpha = B_n T_\alpha^* = \frac{B\cos\alpha}{\sin(\beta-\alpha)}\ \frac{C\sin(\beta-\alpha)\sin\beta}{\cos\alpha} = Cr\sin\beta = Cc \quad (12)$$

$$T_\beta = A_n T_\beta^* = -Cr\sin\alpha = -Cb \quad (13)$$

where $b<0$ because $\alpha<0$, so that the forces are of the same sign. Equations (12) and (13) show that the forces are constant along the members. The ratio of these forces can be expressed as follows:

$$\frac{T_\beta}{T_\alpha} = -\frac{b}{c} = -C_1. \quad (14)$$

The relationship expressed in Equation (14) represents a pivotal link in the statical-geometric interrelation and is characteristic of the whole class of torque-balanced axisymmetric geodesic networks of the present invention.

In order to ascertain the configuration of the surface of the network and other geometric attributes of the networks of the present invention, the following two Equations are required:

$$\frac{r'}{r}\tan\alpha\cdot\tan\beta = \{\ln[r\sin(\alpha+\beta)]\}' \quad (15)$$

$$C_2\sin\theta = r\sin(\alpha+\beta) = x \quad (16)$$

where $\theta$ is the angle between the normal to the surface and the axis of revolution (see FIG. 5) and $C_2$ is a geometric parameter. Thus, the following Equation also holds:

$$\frac{dr}{dz} = r' = \text{cotan}\,\theta. \quad (17)$$

The first principal radius of curvature of a surface of revolution is given by the following formula:

$$R_1 = \frac{1}{\cos\theta} \frac{dr}{d\theta} \tag{18}$$

Combining Equations (6), (16) and (18), yields the following important Equation:

$$R_1 = \frac{2bcC_2(x^4 - p^2q^2)}{[(p^2 - x^2)(x^2 - q^2)]^{3/2}} \tag{19}$$

where $$p^2=(c-b)^2,\ q^2=(c+b)^2 \tag{20}$$

Equation (19), which expressed $R_1$ as an explicit function of angle $\theta$, is the "natural" equation of the meridian of the surface of the networks of the novel structure of the present invention.

Parameters b, c, and $C_2$ can be evaluated using Equations (6) and (16) as soon as values of the radius r and angles $\alpha$ and $\beta$ are selected for any desired value of the angle $\theta$. Then, values r, z, $\alpha$ and $\beta$ can be determined as respective functions of $\theta$ for all $\theta$'s of interest utilizing Equations (6), (16) and (17). However, a more practical alternative is to assume only one of the angles, say the angle $\beta$, and the ratio $T_\alpha/T_\beta$according to Equation (14). The most convenient location for the assignment of the initial data is the equator of the surface where $\theta=2/\pi$, because its plane is the plane of symmetry of the surface and the origin of the axial coordinate z. Consequently, all the necessary computations can be made covering only the part of the range of interest for $z>0$, because the geometry above the equator for the network is a mirror image of the geometry below the equator (see FIG. 6).

Regardless of the set of initial data selected, a prestressed torque-balanced axisymmetric geodesic network becomes uniquely determined by specifying the values of three arbitrary parameters, for example, a, $\alpha_o$ and $\beta_o$. Obviously parameter (a) determines only the physical size of the network and thus simply is a scale factor. The remaining two parameters, $\alpha_o$ and $\beta_o$, govern the configuration of the network and provide a wide variety of forms of the network from which to choose.

Thus, the geometrical arrangement of the two arrays described above produces a condition where the members of one array have a curvature opposite to the curvature of the other array. As a result of these opposed curvatures, when the members are prestressed between the contour elements, they exert mutual lateral pressure. The geometry and prestressing provide lateral stiffness of the network (which can be an envelope) and equilibrium (torque-balance) at the contour elements.

In the description of the invention and particularly in FIGS. 3 and 4, the assignment of the angles $\alpha$ and $\beta$ is merely for convenience and it must be recognized that such angles (and the geometrical arrangement of their corresponding arrays) ,may be reversed.

Figure 5:
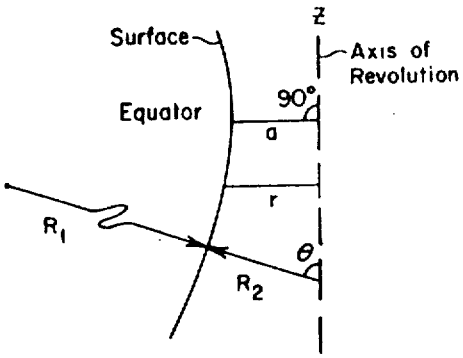
Figure 6:
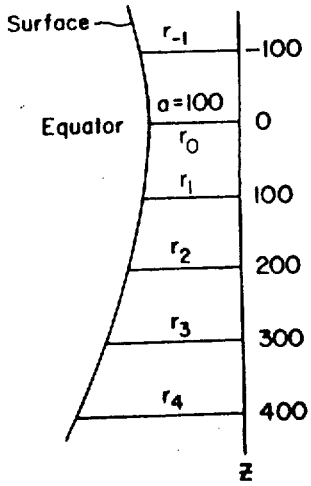

In order to more fully appreciate the flexibility which the novel structure of this invention provides in the number of networks which can be constructed, several numerical values for the parameters, $\beta$ and $T_\alpha/T_\beta$, were used in order to calculate the other variables discussed above for several different networks. In the following table, the angles are expressed in degrees while the length units of z and r are not specified, so that the actual size of the network depends on an arbitrary scale factor. FIGS. 3, 5 and 6 should be referred to also in studying the following table.

TABLE I

| z | | 0 | 100 | 200 | 300 | 400 |
|---|---|---|---|---|---|---|
| $\frac{T_\beta}{T_\alpha} = 0.4$ | r: | 100 | 103 | 112 | 126 | 142 |
| $\beta_o = 23°$ | $\alpha$: | −9.0 | −8.7 | −7.9 | −7.1 | −6.2 |
| | $\beta$: | 23.0 | 22.2 | 20.2 | 17.8 | 15.6 |
| | $\theta$: | 90.0 | 86.3 | 83.3 | 81.1 | 79.5 |
| $\frac{T_\beta}{T_\alpha} = 0.5$ | r: | 100 | 110 | 136 | 169 | 207 |
| $\beta_o = 35°$ | $\alpha$: | −16.7 | −15.1 | −12.2 | −9.6 | −7.7 |
| | $\beta$: | 35.0 | 31.5 | 24.8 | 19.3 | 15.4 |
| | $\theta$: | 90.0 | 79.4 | 73.2 | 70.1 | 68.5 |
| $\frac{T_\beta}{T_\alpha} = 0.5$ | r: | 100 | 107 | 126 | 152 | 182 |
| $\beta_o = 30°$ | $\alpha$: | −14.5 | −13.4 | −11.4 | −9.3 | −7.6 |
| | $\beta$: | 30.0 | 27.7 | 23.4 | 18.9 | 15.3 |
| | $\theta$: | 90.0 | 82.1 | 77.0 | 74.1 | 72.3 |
| $\frac{T_\beta}{T_\alpha} = 0.7$ | r: | 100 | 110 | 137 | 172 | 211 |
| $\beta_o = 30°$ | $\alpha$: | −20.5 | −18.5 | −14.7 | −11.5 | −9.3 |
| | $\beta$: | 30.0 | 27.0 | 21.2 | 16.5 | 13.3 |
| | $\theta$: | 90.0 | 79.0 | 72.6 | 69.6 | 68.1 |
| $\frac{T_\beta}{T_\alpha} = 0.9$ | r: | 100 | 113 | 147 | 191 | 237 |
| $\beta_o = 30°$ | $\alpha$: | −26.7 | −23.3 | −17.6 | −13.3 | −10.5 |
| | $\beta$: | 30.0 | 26.1 | 19.6 | 14.8 | 11.7 |
| | $\theta$: | 90.0 | 75.7 | 68.5 | 65.5 | 64.2 |

From the foregoing discussion, it is readily apparent that structures having a variety of networks can be constructed according to the precepts of the present invention. It must be recognized, however, that strict adherence to the values developed from the mathematical equations given in this application is limited by present day engineering and construction techniques. Thus, for design and construction for structures of the present invention, adherence to the values which can be calculated is recommended, and construction within an engineering tolerance is quite acceptable.

Cooling towers constructed according to present invention can cover the entire range of currently existing and future demand in terms of height. For example, present natural draft towers generally range from about 300 to 600 feet in height. Of course, towers of greater height will have increased utility. Thus, construction of such towers according to the present invention may mean erecting structural members which are several hundred feet in length. A unique way for erecting a cooling tower substantially like that tower shown in FIG. 1, can be practiced as follows. One array of members comprises bands which can be overlapped for forming a shell if desired. The other array comprises cables. The cables are attached to the upper spacer ring (ring member 8 in FIG. 1) which ring is suspended from the column (column 14) and lifted to its design position. The lower ends of all odd-numbered, for example, cables are anchored one by one in their design position on the lower ring (transition joint member 10 in FIG. 1) while the even-numbered cables are anchored temporarily in the positions of the bands. The cables of one set (say the odd-numbered cables) are prestressed which induces tension in the second set of cables. As a result, a sparse, slightly prestressed cable network is formed which is capable of resisting wind load.

Then, the even-numbered cables are replaced one-by-one by the bands and the lower ends of the even-numbered cables are shifted to their proper design position and fixed, while simultaneously mounting the bands by anchoring and tensioning them in their design position. If required, a final tension adjustment can be made individually for the bands and cables within an assigned tolerance. An alternative method of erecting the tower is to attach all cables and bands in the proper positions on the upper spacer ring and the lower transition joint, and lift the spacer ring to its design position. Of course, other methods for erecting the novel tower may be developed and are included within the teaching of this disclosure.

For the alternative design given in FIG. 2B, the erection procedure is similar to the procedure described above. In this case, the lower ring has to be attached to the sparse cable network and lifted by the network into its design position. If the ring is to be made of reinforced concrete, for example, a thin-sheet annular casing can be lifted and then concrete poured into it. The casing should be complete with devices for anchoring the bands and the cables. The weight of the reinforced concrete spacer ring is a positive factor since it provides a certain part of the prestressing load required and, therefore, lightens the lower suspension system.

The process of lifting the upper spacer ring (and a lower spacer ring if there is one) with all of the cable attached can be completed in a relatively short time because of the absence of any simultaneous assembly of the cables and bands. Also, the cable and bands are not attached to each other at their intersection which also simplifies the erection process. For a further illustration of the present invention, the following design example is given, but it should not be construed as a limitation of the present invention.

DESIGN EXAMPLE

To further illustrate a natural draft cooling tower constructed from the novel structure of the present invention, this design example details the typical structural components that may be required for a 544 foot high tower (from ground to top of network) which employs steel bands and cables as members of the two arrays. The bands are overlapped to form a shell. The tower is like that shown in FIG. 2B. All steel members employ steel of a strength typical for the particular structural shape.

Referring to FIG. 2B, the vertical height between ring 8 and the top of column 14 is 140 feet and the vertical distance between ring 30 and the ground is 112 feet. The network (or shell formed from the two arrays) is 432 feet in height, has a top diameter of 321 feet, and a bottom diameter of 406 feet. The diameter is a minimum at the equator of the surface. This minimum diameter is 270 feet and is located 158 feet from the top of the network. The following table displays the details of the structural components of such a tower.

TABLE II

| Structural Member | Number of Members Req'd. | Cross Section | Length (ft) | Spacing (ft) Top/Bottom | Total Weight (× 1000 lbs) | Prestressing Force (× 1000 lbs) |
|---|---|---|---|---|---|---|
| Tower Bands (steel) | 236 | 6 ft × 1/16 in | 457 | 4.3/5.4 | 1,648 | 74/Band |
| Tower Cables (steel) | 236 | 1 5/16 in Diam. | 617 | 4.3/5.4 | 527 | 14/Cable |
| Upper Spacer Ring (steel) | 1 | 162 $in^2$ | 1000 | N/A | 557 | 3,898 (Compressive) |
| Lower Spacer Ring (reinforced concrete) | 1 | 11.8 $ft^2$ | 1275 | N/A | 2,342 | 3,396 (Compressive) |
| Upper Suspension Cables (steel) | 54 | 4 in Diam. | 210 | 1.4/18.7 | 381 | 611/Cable |
| Lower Suspension Cables (steel) | 54 | 3⅝ in Diam. | 250 | 23.6/2.0 | 372 | 585/Cable |
| Foundation Ties (steel rods) | 54 | 3⅛ in Diam. | 120 | 23.6/30.4 | 150 | N/A |
| Central Column (reinforced concrete) | 1 | 106 $ft^2$ | 700 | N/A | 11,650 | 20,735 (top) 31,651 (Bottom) |

Obviously, it will be appreciated that the tabulated results are merely examplary and are not a limitation of the invention. Also, such results are for design and illustration purposes only and are not necessarily to be relied upon as the full engineering for construction of such a tower. Several advantages are realized with the tower of this design example which are not readily apparent. The modulus of elasticity is different for each array (i.e. for the array of bands and for the array of cables). This difference is beneficial in that the overlapped bands which form the shell have a higher modulus of elasticity and a greater cross-sectional area than the cables. The higher modulus of elasticity and greater cross-sectional area of the bands both positively contribute to increased stiffness of the tower which results in better (less) lateral deflection of the tower under wind or other loads. Thus, the tower of this design example is designed to withstand a 100 mph wind load.

Of course, different material for each array can be used to provide favorable differences in the modulus of elasticity of the two arrays as the skilled artisan will appreciate. Suitable materials for the arrays include metal such as, for example, steel, aluminum, various alloys, etc; fiberglass and other fiber reinforced resins (plastics): and like materials.

Another unique feature of the tower of this design example (and the towers of FIGS. 1 and 2) is the combination of an interior compression column and the network which has a net force (or forces) acting in the meridional direction (i.e. the network is being stretched meridionally or vertically with respect to the column). The compression of the central column clearly is advantageous for such self-balanced network and compression column combination.

We claim:

1. A structure of tensile members requiring only two arrays of said members for obtaining ostensible rigidity of said structure, each member of each array being attached at its ends to two spaced-apart contour elements, the members of each array having opposed curvatures for forming an axisymmetric geodesic network within said contour elements which network is a section of a surface of revolution, the members of each array not being attached to each other or to the members of the other array so that the members of both arrays are not constrained against movement in the surface of the network within said contour elements, the first array forming a negative angle $\alpha$ with respect to the meridian of said surface of revolution and the second array forming a positive angle $\beta$ with respect to the meridian of said surface of revolution, where $|\beta| > |\alpha|$, said members of both arrays being prestressed such that said opposed curvature members of each array exert mutual lateral force against each other for obtaining said ostensible rigidity of said network, wherein the members of one of such arrays are bands overlapped to form a membrane and such that, at each point where a member of said first array contacts a member of said second array, the components of the initial prestressing forces of each array along a line normal to the plane passing through said point and the axis of symmetry of said surface of revolution are equal and opposite.

2. The structure of claim 1 wherein $\alpha$ is between about $-5°$ and $-60°$ and $\beta$ is between about 7° and 80°.

3. The structure of claim 1 wherein said network is a surface of revolution and said contour elements are an upper rigid ring member and a lower transition member, the planes of said members being normal to the axis of revolution, there being a compression column interior of said network and along said axis of revolution, the lower end of said column being fixed to the ground, said upper ring member being attached to said compression column about its upper end and said lower transition member being attached to the ground.

4. The structure of claim 1 wherein said network is a surface of revolution and said contour elements are an upper and a lower rigid ring member whose plane is normal to the axis of revolution, there being a compression column interior of said network and along said axis of revolution, the lower end of said column being fixed to the ground, said upper ring member being attached to said compression column about its upper end and said lower ring member being attached to said column about its lower end.

5. The structure of claim 1 wherein for prestressing said members, the following equations for said members are satisfied:

$$\frac{\sigma_\alpha}{\sigma_\beta} = C_1 \frac{\cos\alpha}{\cos\beta},$$

where $\sigma_\alpha$ and $\sigma_{62}$ are the normal curvatures of the first and second array, respectively, and for said torque-balancing, $$C_1 = \frac{\sin\alpha}{\sin\beta} = \frac{b}{c},$$

where b and c are the parameters of the geodesic lines for said first and second array, respectively, on said surface of revolution.

6. The structure of claim 5 wherein for said torque-balancing, the following equation also is satisfied, $$\frac{T_\beta}{T_\alpha} = -\frac{b}{c} = -C_1,$$

where $T_\alpha$ and $T_\beta$ are the forces per unit increments dv=1 and du=1 of the coordinates of the members for said first array and said second array, respectively, where u and v are the vectors of the members of said first array and said second array respectively.

7. The structure of claim 6 wherein the first principal radius of curvature ($R_1$) of said surface of revolution is given by the following equation:

$$R_1 = \frac{2bcC_2(x^4 - p^2q^2)}{[(p^2 - x^2)(x^2 - q^2)]^{3/2}}$$

where, $$p^2 = (c-b)^2,$$

$$q^2 = (c+b)^2,$$

$$x = C_2 \sin\theta = r \sin(\alpha+\beta),$$

z is a distance measured along said axis, $r \sin\alpha = b$ $r \sin\beta = c$, $\theta$ is the angle between the normal to said surface and the axis of revolution of said surface, r is the radius of said surface of revolution.

8. The structure of claim 1 wherein the members of said first array have a different modulus of elasticity than the members of said second array.

9. The structure of claim 1 wherein the members of each array are composed of the same material and said material for each array independently is selected from the group consisting of metal, fabric and reinforced cured resin.

10. In combination a tower and a compression column, said tower comprised of an ostensibly rigid, axisymmetric geodesic network of two arrays of prestressed tensile members, each member of each array being attached at its ends to two spaced apart contour elements, the members of each array having opposed curvatures for forming an axisymmetric geodesic network within said contour elements which network is a section of a surface of revolution, the members of each array not being attached to each other or to the members of the other array so that the members of both arrays are not constrained against movement in the surface of the network within said contour elements, the first array forming a negative angle $\alpha$ with respect to the meridian of said surface of revolution and the second array forming a positive angle $\beta$ with respect to the meridian of said surface of revolution, where $|\beta| > |\alpha|$, said members of both arrays being prestressed such that said opposed curvature members of each array exert mutual lateral force against each other for obtaining said ostensible rigidity of said network, wherein the members of one of such arrays are bands overlapped to form a membrane and such that, at each point where a member of said first array contacts a member of said second array, the components of the initial prestressing forces of each array along a line normal to the plane passing through said point and the axis of symmetry of said surface of revolution are equal and opposite, said contour elements being attached to said compression column.

11. In combination a tower and a compression column, said tower comprised of an ostensibly rigid, axisymmetric geodesic network of two arrays of prestressed tensile members, each member of each array being attached at its ends to two spaced apart contour elements, the members of each array having opposed curvatures for forming an axisymmetric geodesic network within said contour elements which network is a section of a surface of revolution, the members of each array not being attached to each other or to the members of the other array so that the members of both arrays are not constrained against movement in the surface of the network within said contour elements, the first array forming a negative angle with respect to the meridian of said surface of revolution and the second array forming a positive angle $\beta$ with respect to the meridian of said surface of revolution, where $|\beta| > |\alpha|$, said members of both arrays being prestressed such that said opposed curvature members of each array exert mutual lateral force against each other for obtaining said ostensible rigidity of said network, wherein the members of one of such arrays are bands overlapped to form a membrane and such that, at each point where a member of said first array contacts a member of said second array, the components of the initial prestressing forces of each array along a line normal to the plane passing through said point and the axis of symmetry of said surface of revolution are equal and opposite, said compression column being fixed to the ground at its lower end, said upper contour element being attached to said column about its upper end and said lower contour element being attached to the ground.

12. A process for erecting a structure of tensile members, said structure comprising a first and a second array of said members, wherein only said first and second arrays are required for obtaining ostensible rigidity of said structure, which method comprises:

(a) attaching one end of each of said members of said first array to an upper ring member;

(b) positioning said array-attached upper ring member about the upper end of a central support column;

(c) attaching the other ends of the members of said first array to a lower ring member having first and second sets of attachment points, a portion of said other ends of the members of said first array being attached to some of said first set of attachment points and the remainder of said other ends of said members of said first array being attached to some of said second set of attachment points, thereby locating said lower ring member in its position relative to said central column;

(d) prestressing said portion of said members of said first array, thereby inducing tension in said remainder of said members of said first array;

(e) attaching one member of said second array to said upper ring member and to one of said second set of attachment points on said lower ring member, and moving the said other end of any member of said first array previously attached to said one of said second set of attachment points to an unoccupied one of said first set of attachment points; and (f) repeating step (e) until all the members of said first array are attached to said first set of attachment points on said lower ring member, and all the members of said second array are attached to said upper ring member and to said second set of attachment points on said lower ring member, said members of both arrays being tensioned or prestressed such that said members of each array exert mutual lateral force against said members of said other array for obtaining said ostensible rigidity of said network, such that, at each point where a member of said first array contacts a member of said second array, the components of the initial prestressing forces of each array along a line normal to the plane passing through said point and the axis of symmetry of said surface of revolution are equal and opposite, the members of each array having opposed curvatures for forming an axisymmetric geodesic network, the members of each array not being attached to each other or to the members of the other array so that said members are not constrained against movement in the surface of said structure, said first array forming a negative angle $\alpha$ with respect to the meridian of said surface and said second array forming a positive angle $\beta$ with respect to the meridian of said surface, where $|\beta| > |\alpha|$.

13. The process of claim 12 wherein said members of said first array are cables or bands, and said members of said second array are cables or bands.

14. The process of claim 13 wherein the members of one of said arrays are bands which are overlapped to form a membrane.

15. The process of claim 12 wherein for prestressing said arrays and for torque-balancing said network, the following equations are satisfied:

$$\frac{\sigma_\alpha}{\sigma_\beta} = C_1 \frac{\cos\alpha}{\cos\beta}$$

$$C_1 = \frac{\sin\alpha}{\sin\beta} = \frac{b}{c},$$

where $\sigma_\alpha$ and $\sigma_{62}$ are the normal curvatures of said first and said second array, respectively, b and c define the sets of geodesic lines for said first and second array, respectively, on said surface of revolution; and $$\frac{T_\beta}{T_\alpha} = -\frac{b}{c} = -C_1,$$

where $T_{60}$ and $T_{62}$ are the forces per unit increments dv=1 and du=1 of the coordinates of the members of said first array and said second array, respectively, where u and v are vectors of the members of said first array and said second array, respectively; and the first principal radius of curvature ($R_1$) of said surface of revolution is :

$$R_1 = \frac{2bcC_2(x^4 - p^2q^2)}{[(p^2 - x^2)(x^2 - q^2)]^{3/2}}$$

where, $\theta$ is the angle between the normal to said surface and the axis of revolution of said surface, r is the radius of said surface of revolution, $$p^2 = (c-b)^2$$

$q^2=(c+b)^2$ $x=C_2 \sin\theta=r \sin(\alpha+\beta)$, z is a distance measured along said axis, b=r sin$\alpha$, and c=r sin$\beta$.

16. The process of claim 15 wherein $\alpha$ is between about $-60°$ and $-5°$ and $\beta$ is between about 7° and 80°.

* * * * *

UNITED STATES PATENT OFFICE
CERTIFICATE OF CORRECTION

PATENT NO. : 4,473,976

DATED : Oct. 2, 1984

INVENTOR(S) : Edward N. Kuznetsov and Jack J. Groom

It is certified that error appears in the above-identified patent and that said Letters Patent are hereby corrected as shown below:

The omission of Figs. 3 through 6 (Sheet No. 2 of 2) is hereby corrected by the inclusion of the attached formal sheet of drawings.

Signed and Sealed this

*Thirtieth* Day of *July 1985*

[SEAL]

*Attest:*

DONALD J. QUIGG

*Attesting Officer* *Acting Commissioner of Patents and Trademarks*